US010083804B2

(12) United States Patent
Lai

(10) Patent No.: US 10,083,804 B2
(45) Date of Patent: Sep. 25, 2018

(54) SPEED CONTROL SWITCH

(71) Applicants: Dongguan Chen Da Appliance Co., Ltd., Dongguan (CN); Defond Components Limited, Chaiwan (HK)

(72) Inventor: Chi Ming Lai, Dongguan (CN)

(73) Assignees: Defond Electech Co., Ltd., Dongguan (CN); Defond Components Limited, Chaiwan (HK)

( * ) Notice: Subject to any disclaimer, the term of this patent is extended or adjusted under 35 U.S.C. 154(b) by 0 days.

(21) Appl. No.: 15/685,840

(22) Filed: Aug. 24, 2017

(65) Prior Publication Data

US 2018/0061596 A1 Mar. 1, 2018

(30) Foreign Application Priority Data

Aug. 26, 2016 (CN) ..... 2016 2 0949531 U

(51) Int. Cl.

| | |
|---|---|
| ***H01H 13/18*** | (2006.01) |
| ***H01H 13/14*** | (2006.01) |
| *H01C 10/38* | (2006.01) |
| *H01H 19/14* | (2006.01) |
| *H01H 21/24* | (2006.01) |

(52) U.S. Cl.
CPC ..... *H01H 13/186* (2013.01); *H01H 13/14* (2013.01); *H01C 10/38* (2013.01); *H01H 19/14* (2013.01); *H01H 21/24* (2013.01)

(58) Field of Classification Search
CPC ..... H01H 13/186; H01H 19/14; H01C 10/38
USPC ..... 200/522
See application file for complete search history.

(56) References Cited

U.S. PATENT DOCUMENTS

2013/0140167 A1* 6/2013 Kobayashi ..... H01H 13/04 200/522

* cited by examiner

*Primary Examiner* — Renee S Luebke
*Assistant Examiner* — Iman Malakooti
(74) *Attorney, Agent, or Firm* — Wang Law Firm, Inc.

(57) ABSTRACT

A speed control switch includes a base. An upper end of the base is provided with a switch assembly. A side of the base is provided with a PCB board and a slide terminal. The PCB board is provided with a first contact plate. The slide terminal is slidably connected with the first contact plate. The base is provided with a trigger assembly for driving the slide terminal to slide along the first contact plate and to close the switch assembly. The speed control switch can regulate the speed of a motor precisely. The structure is compact to reduce the size of the switch, so that it is convenient for operation.

6 Claims, 4 Drawing Sheets

SPEED CONTROL SWITCH

FIELD OF THE INVENTION

The present invention relates to a trigger switch, and more particularly to a speed control switch.

BACKGROUND OF THE INVENTION

A speed control switch uses an electronic circuit or a microprocessing chip to change the graduation, voltage, current, frequency and the like of the motor for controlling the rotational speed of the motor, so that the motor can achieve a higher performance of an electronic switch.

Conventional speed control switches on the market employ step speed regulation or point contact at a high speed, but the swing of the switch is too large. It is unable to achieve precise speed regulation. The structure is complex, and the size is also relatively large. The overall operation is inconvenient. Accordingly, the inventor of the present invention has devoted himself based on his many years of practical experiences to solve these problems.

SUMMARY OF THE INVENTION

In view of the shortcomings of the prior art, the primary object of the present invention is to provide a speed control switch for regulating the speed of a motor precisely. The structure is compact to reduce the size of the switch, so that it is convenient for operation.

In order to achieve the aforesaid object, the speed control switch of the present invention comprises a base. An upper end of the base is provided with a switch assembly. A side of the base is provided with a PCB board and a slide terminal. The PCB board is provided with a first contact plate. The slide terminal is slidably connected with the first contact plate. The base is provided with a trigger assembly for driving the slide terminal to slide along the first contact plate and to close the switch assembly.

Preferably, the switch assembly includes a main switch terminal, a second contact plate, and a secondary switch terminal disposed above the main switch terminal. The second contact plate includes a main body portion and a bent portion bent upward. The secondary switch terminal is fixedly connected to the bent portion of the second contact plate.

Preferably, a bending angle between the bent portion and the main body portion is in the range of 30-50 degrees.

Preferably, the trigger assembly includes a push handle and a drive mechanism for driving the push handle to move linearly. A first end of the push handle is connected with the drive mechanism. A second end of the push handle is provided with a contact head. The contact head is slidably connected with the second contact plate.

Preferably, the push handle has an engaging groove. An upper end of the slide terminal is provided with an engaging block to engage with the engaging groove.

Preferably, the drive mechanism includes a trigger and a support lever disposed at a middle portion of the trigger. An upper end of the trigger is hinged to the first end of the push handle. One end of the support lever is connected to the base. Another end of the support lever is hinged to the trigger.

Preferably, the junction of the support lever and the trigger is defined as a dividing point. The trigger is divided into an effort arm and a resistance arm by the dividing point. The effort arm has a length greater than that of the resistance arm.

Preferably, the resistance arm is provided with a spring for returning. One end of the spring is connected to the base. Another end of the spring is connected to the resistance arm of the trigger.

The beneficial effects of the present invention are described below. A speed control switch comprises a base. An upper end of the base is provided with a switch assembly. A side of the base is provided with a PCB board and a slide terminal. The PCB board is provided with a first contact plate. The slide terminal is slidably connected with the first contact plate. The base is provided with a trigger assembly for driving the slide terminal to slide along the first contact plate and to close the switch assembly. After the trigger assembly drives the switch assembly to close the circuit of the switch, the speed control switch is activated, while the trigger assembly drives the slide terminal to slide along the first contact plate. The PCB board is connected with an external computer for controlling the rotational speed of a motor. The farther the slide terminal is slid away from the first contact plate, the faster the rotational speed of the motor is. The speed of the motor can be regulated precisely. The structure is compact to reduce the size of the switch, so that it is convenient for operation.

DETAILED DESCRIPTION OF THE PREFERRED EMBODIMENTS

Embodiments of the present invention will now be described, by way of example only, with reference to the accompanying drawings.

Figure 1:
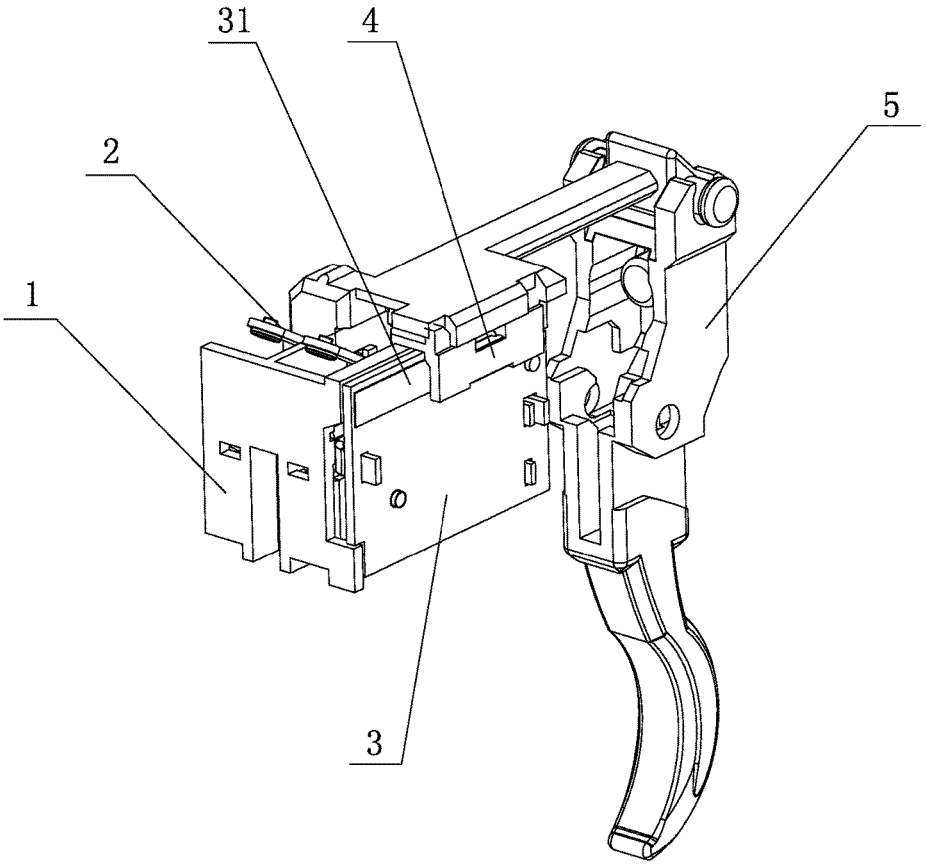
FIG. 1 is a perspective view of the present invention.
Figure 2:
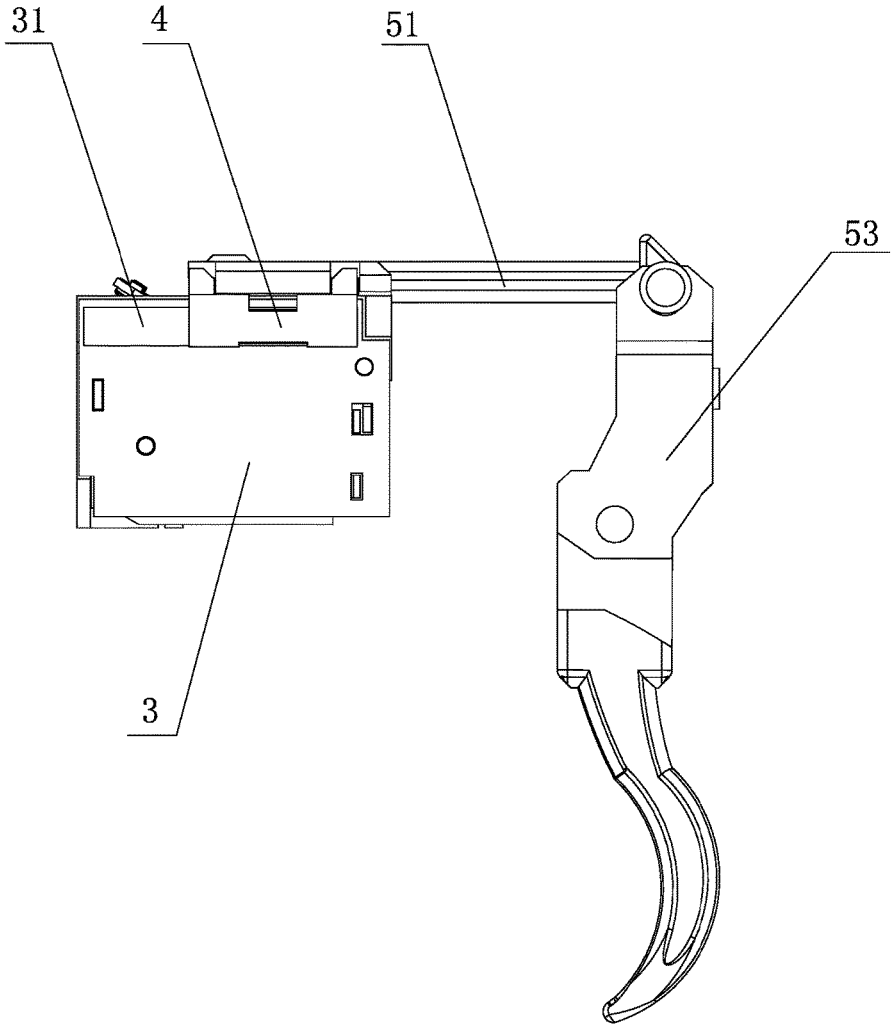
FIG. 2 is a right side view of the present invention.

As shown in FIG. 1 and FIG. 2, a speed control switch according to an embodiment of the present invention comprises a base 1. An upper end of the base 1 is provided with a switch assembly 2. A side of the base 2 is provided with a PCB board 3 and a slide terminal 4. The PCB board 3 is provided with a first contact plate 31. The slide terminal 4 is slidably connected with the first contact plate 31. The base 1 is provided with a trigger assembly 5 for driving the slide terminal 4 to slide along the first contact plate 31 and to close the switch assembly 2.

In this embodiment, after the trigger assembly 5 drives the switch assembly 2 to close the circuit of the switch, the speed control switch is activated, while the trigger assembly 5 drives the slide terminal 4 to slide along the first contact plate 31. The PCB board 3 is connected with an external computer for controlling the rotational speed of a motor. The farther the slide terminal 4 is slid away from the first contact plate 31, the faster the rotational speed of the motor is. The speed of the motor can be regulated precisely. The structure is compact to reduce the size of the switch, so that it is convenient for operation.

Figure 3:
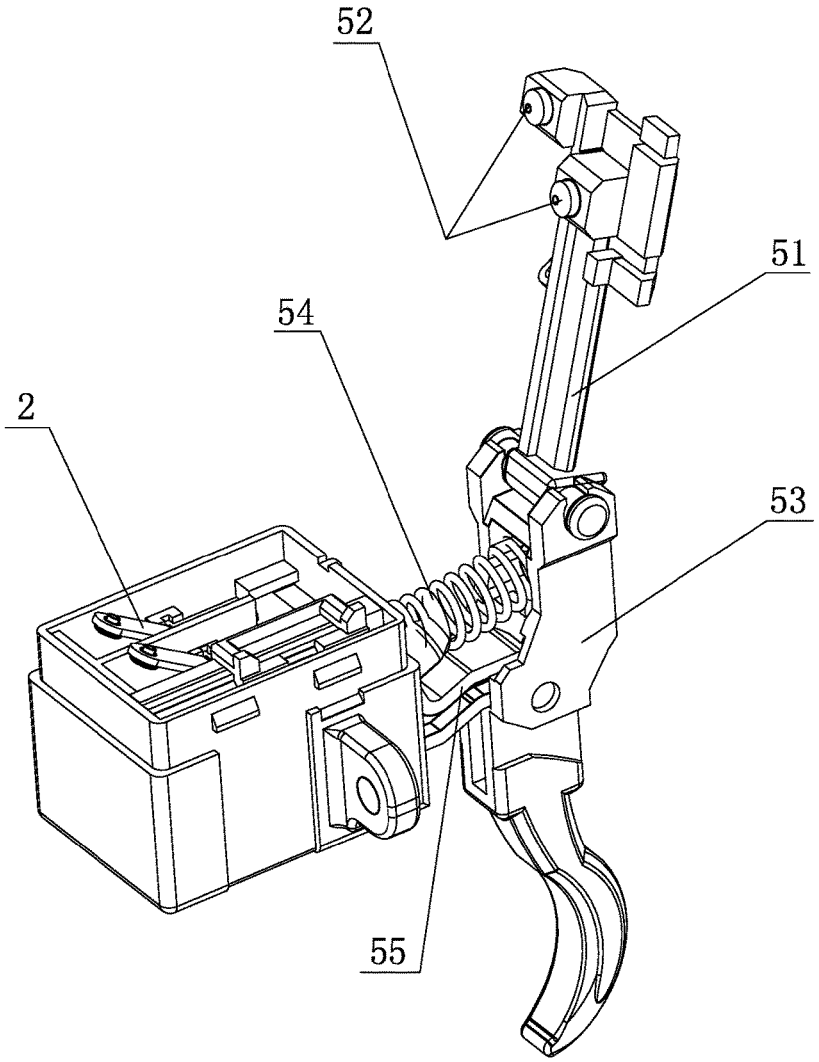
FIG. 3 is another perspective view of the present invention.

As shown in FIG. 3, in this embodiment, the switch assembly 2 includes a main switch terminal 21, a second contact plate 22, and a secondary switch terminal 23 disposed above the main switch terminal 21. The second contact plate 22 includes a main body portion 221 and a bent portion 222 bent upward. The secondary switch terminal 23 is fixedly connected to the bent portion 222 of the second contact plate 22. The trigger assembly 5 drives the bent portion 222 of the second contact plate 22 to be turned downward, so that the secondary switch terminal 23 is in contact with the main switch terminal 21, that is, the circuit of the switch is closed and the speed control switch starts working.

In this embodiment, the bending angle between the bent portion 222 and the main body portion 221 is in the range of 30-50 degrees. If the bending angle is too small, the main body portion 221 of the second contact plate 22 when turned upward may interfere with the trigger assembly 5, affecting the trigger assembly 5 to drive the switch assembly 2 to be closed. If the bending angle is too large, the swing of the bent portion 222 of the second contact plate 22 is too large. As a result, the speed regulation is not precise.

Figure 4:
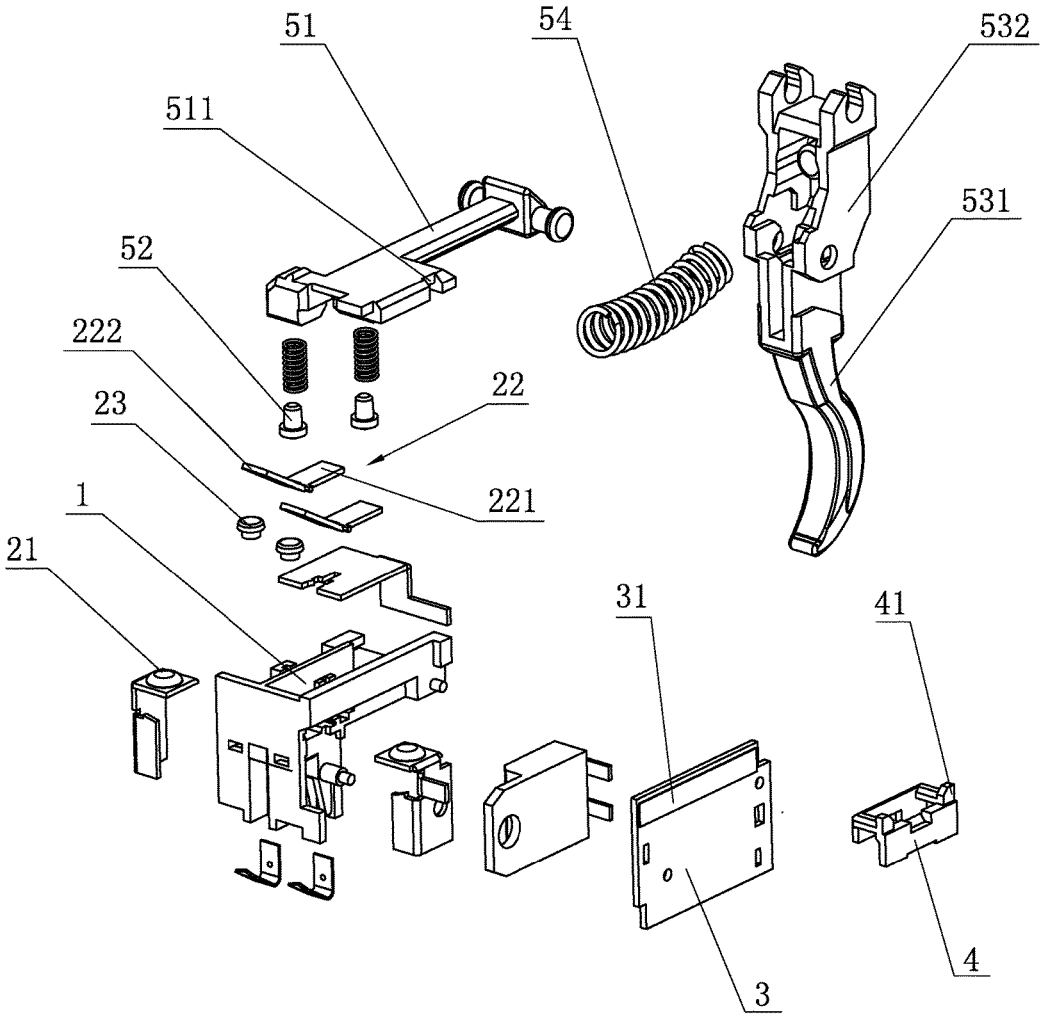
FIG. 4 is an exploded of the present invention.

As shown in FIG. 4, in this embodiment, the trigger assembly 5 includes a push handle 51 and a drive mechanism for driving the push handle 51 to move linearly. A first end of the push handle 51 is connected with the drive mechanism. A second end of the push handle 51 is provided with a contact head 52. The contact head 52 is slidably connected with the second contact plate 22. When the drive mechanism drives the push handle 51 to move linearly, the contact head 52 is slid to get contact with the main body portion 221 of the second contact plate 22. When the contact head 52 is in contact with the bent portion 222 of the second contact plate 22, the bent portion 222 of the second contact plate 22 is turned downward so that the secondary switch terminal 23 gets contact with the main switch terminal 21, that is, the circuit of the switch is closed and the speed control switch starts working.

In this embodiment, the push handle 51 has an engaging groove 511. An upper end of the slide terminal 4 is provided with an engaging block 41 to engage with the engaging groove 511 so that the slide terminal 41 and the push handle 51 are connected. When the drive mechanism drives the push handle 51 to move linearly, the push handle 51 drives the slide terminal 4 to slide along the first contact plate 31.

In this embodiment, the drive mechanism includes a trigger 53 and a support lever 55 disposed at a middle portion of the trigger 53. An upper end of the trigger 53 is hinged to the first end of the push handle 51. One end of the support lever 55 is connected to the base 1. Another end of the support lever 55 is hinged to the trigger 53. The hinged point of the trigger 53 and the support lever 55 serves as a fulcrum. With the lever principle, when the trigger 53 is triggered, the trigger 53 will drive the push handle 51 to move linearly.

In this embodiment, the junction of the support lever 55 and the trigger 53 is defined as a dividing point. The trigger 53 is divided into an effort arm 531 and a resistance arm 532 by the dividing point. The length of the effort arm 531 is greater than the length of the resistance arm 532. The first contact plate 31 on the PCB board 3 is engraved with a plurality of speed regulation graduations. An interval is defined between every adjacent two of the speed regulation graduations. The slide terminal 4 can be slid from one speed regulation graduation to another speed regulation graduation to change the rotational speed of the motor. When the operator touches the trigger 53 by accident, because the length of the effort arm 531 is greater than the length of the resistance arm 532, according to the lever principle, the hinged point of the trigger 53 and the support lever 55 serves as a fulcrum, the movement distance of the effort arm 531 of the trigger 53 is greater than the movement distance of the resistance arm 532, that is, the push handle 51 urges the slide terminal 4 to slide on the first contact plate 31 by a distance less than the distance that the trigger 53 is triggered. Because the slide distance of the slide terminal 4 on the first contact plate 31 is less than the distance that the trigger 53 is triggered, the slide terminal 4 cannot be slid from one speed regulation graduation to another speed regulation graduation to change the rotational speed of the motor so as to ensure the normal operation of the motor.

In this embodiment, the resistance arm 532 is provided with a spring 54 for returning. One end of the spring 54 is connected to the base 1, and another end of the spring 54 is connected to the resistance arm 532 of the trigger 53. When the operator triggers the trigger 53, the spring 54 will be pulled. When the operator releases the trigger 53, the resistance arm 532 is returned by the elasticity of the spring 54. It is more convenient for operation.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A speed control switch, comprising a base, an upper end of the base being provided with a switch assembly, a side of the base being provided with a PCB board and a slide terminal, the PCB board being provided with a first contact plate, the slide terminal being slidably connected with the first contact plate, the base being provided with a trigger assembly for driving the slide terminal to slide along the first contact plate and to close the switch assembly;

wherein the switch assembly includes a main switch terminal, a second contact plate, and a secondary switch terminal disposed above the main switch terminal, the second contact plate includes a main body portion and a bent portion bent upward, and the secondary switch terminal is fixedly connected to the bent portion of the second contact plate; and wherein the trigger assembly includes a push handle and a drive mechanism for driving the push handle to move linearly, a first end of the push handle is connected with the drive mechanism, a second end of the push handle is provided with a contact head, and the contact head is slidably connected with the second contact plate.

2. The speed control switch as claimed in claim 1, wherein a bending angle between the bent portion and the main body portion is in the range of 30-50 degrees.

3. The speed control switch as claimed in claim 1, wherein the push handle has an engaging groove, and an upper end of the slide terminal is provided with an engaging block to engage with the engaging groove.

4. The speed control switch as claimed in claim 1, wherein the drive mechanism includes a trigger and a support lever disposed at a middle portion of the trigger, an upper end of the trigger is hinged to the first end of the push handle, one end of the support lever is connected to the base, and another end of the support lever is hinged to the trigger.

5. The speed control switch as claimed in claim 4, wherein the junction of the support lever and the trigger is defined as a dividing point, the trigger is divided into an effort arm and a resistance arm by the dividing point, and the effort arm has a length greater than that of the resistance arm.

6. The speed control switch as claimed in claim 5, wherein the resistance arm is provided with a spring for returning, one end of the spring is connected to the base, and another end of the spring is connected to the resistance arm of the trigger.

* * * * *